United States Patent [19]

Aoki et al.

[11] 4,171,658

[45] Oct. 23, 1979

[54] ELECTRONIC MUSICAL INSTRUMENT

[75] Inventors: Eiichiro Aoki; Tsutomu Suzuki, both of Hamamatsu, Japan

[73] Assignee: Nippon Gakki Seizo Kabushiki Kaisha, Hamamatsu, Japan

[21] Appl. No.: 845,595

[22] Filed: Oct. 26, 1977

[30] Foreign Application Priority Data

Oct. 29, 1976 [JP] Japan ..... 51-130189
Oct. 29, 1976 [JP] Japan ..... 51-130190

[51] Int. Cl.[2] ..... G10H 1/00; G10H 5/00

[52] U.S. Cl. ..... 84/1.03; 84/1.24; 84/DIG. 12; 84/DIG. 22

[58] Field of Search ..... 84/1.01, 1.03, 1.17, 84/1.24, DIG. 12, DIG. 22

[56] References Cited

U.S. PATENT DOCUMENTS

| | | | |
|---|---|---|---|
| Re. 29,144 | 3/1977 | Bunger | 84/1.01 |
| 3,839,592 | 10/1974 | Freeman | 84/1.01 |
| 3,842,701 | 10/1974 | Robinson et al. | 84/1.03 |
| 3,854,366 | 12/1974 | Deutsch | 84/1.24 |
| 4,000,674 | 1/1977 | Schreier | 84/1.01 |

*Primary Examiner*—Stanley J. Witkowski
*Attorney, Agent, or Firm*—Spensley, Horn, Jubas & Lubitz

[57] ABSTRACT

An electronic musical instrument of a type having automatic performance functions includes means for switching a tone production mode to another tone production mode without stop of tone production when the automatic performance is stopped, so that a smooth continuation of a manual performance after the automatic performance is ensured. When an automatic arpeggio performance producing a tone of a percussion type envelope is stopped, the tone envelope is switched to a sustain type envelope and the tone is kept produced as long as the key for the tone is kept depressed. In an automatic bass/chord performance producing intermittent bass tones and chord tones, bass tones and chord tones are continuously produced after stopping of the automatic bass/chord performance.

3 Claims, 7 Drawing Figures

ELECTRONIC MUSICAL INSTRUMENT

BACKGROUND OF THE INVENTION

This invention relates to electronic musical instruments having automatic performance functions, and more particularly to tone production control when an automatic performance is temporarily suspended in such an electronic musical instrument.

Known in the art is an electronic musical instrument having automatic performance functions in which an effect like arpeggio is automatically realized by producing successively, one after another, at suitable time intervals tones concerning one or plural keys in the keyboard. In this automatic arpeggio performance, the tones thereof are automatically produced one by one in a percussive mode at desired time intervals. The term "percussive mode" used herein is intended to mean a mode in which an envelope of each produced tone decays with time immediately after a rising portion of the envelope.

Furthermore, known in the art is an electronic musical instrument having as its automatic performance functions an automatic bass/chord performance function and an automatic rhythm performance function. In the case where a chord is automatically performed with the electronic musical instrument of this type, a key or plural keys in a chord are depressed in the keyboard and the chord name is automatically determined from the key or the combination of the keys depressed to specify the tones to be produced, and furthermore tones are produced as bass tones one by one according to a desired bass pattern with tones corresponding to the root note and subordinate note of the chord. The term "subordinate-note" used herein is intended to mean a note having a predetermined note interval (first, major second, minor third, major third, etc.) with respect to the root note. The bass pattern is determined in correspondence to a desired rhythm pattern selected by a performer. In this operation, the specified tones are controlled so as to be simultaneously produced as an automatic chord, tone for every suitable timing corresponding to the aforementioned rhythm. Furthermore, the automatic rhythm tone is produced in correspondence to the selected rhythm, as a result of which the automatic bass tone, the automatic chord tone, and the automatic rhythm tone are produced in combination, whereby the automatic performance is carried out. Generally these automatic performance tones are produced in an intermitent mode which is intended to mean a mode in which a tone or tones are produced intermittently one by one or all together with predetermined time intervals.

However, it is very inconvenient for the electronic musical instrument having the various automatic performance functions described above that when the automatic performance functions are stopped, tones immediately stop producing as a necessary consequence in spite of continuous depression of the key or keys. As a result, interest in playing the electronic musical instrument may be greatly reduced. In addition, since key depression is effected in the automatic performance, it is considerably inconvenient to stop the automatic performance by hand.

In the case where the automatic performance is stopped, or in the case where the automatic performance is switched over to the manual performance, it is desirable to continue the tone production and further, to change the tone production mode to a sustaining mode and a continuous mode. The terms "sustaining mode" and "continuous mode" used herein are intended to mean a mode in which an envelope of each produced tone is sustained with a substantially constant level after a rising portion of the envelope and a mode in which a tone or tones are produced continuously one by one or all together, respectively. Thus the manual performance can smoothly follow the automatic performance with a clearly distinguishable difference in the tone production mode giving an attractive effect to a sound.

SUMMARY OF THE INVENTION

Accordingly, an object of this invention is to provide an electronic musical instrument having automatic performance functions in which when the automatic performance is stopped, its tone production is continued. Another object of the invention is to provide an electronic musical instrument having automatic performance functions in which a tone production mode or modes are changed in accordance with the change of the performance mode between automatic and manual ones.

The novel features which are considered characteristic of this invention are set forth in the appended claims. The invention itself, however, together with additional objects and advantages thereof will be best understood from the following detailed description taken in conjunction with the accompanying drawings in which like parts are designated by liek reference numerals or characters.

DESCRIPTION OF THE PREFERRED EMBODIMENTS

Figure 1:
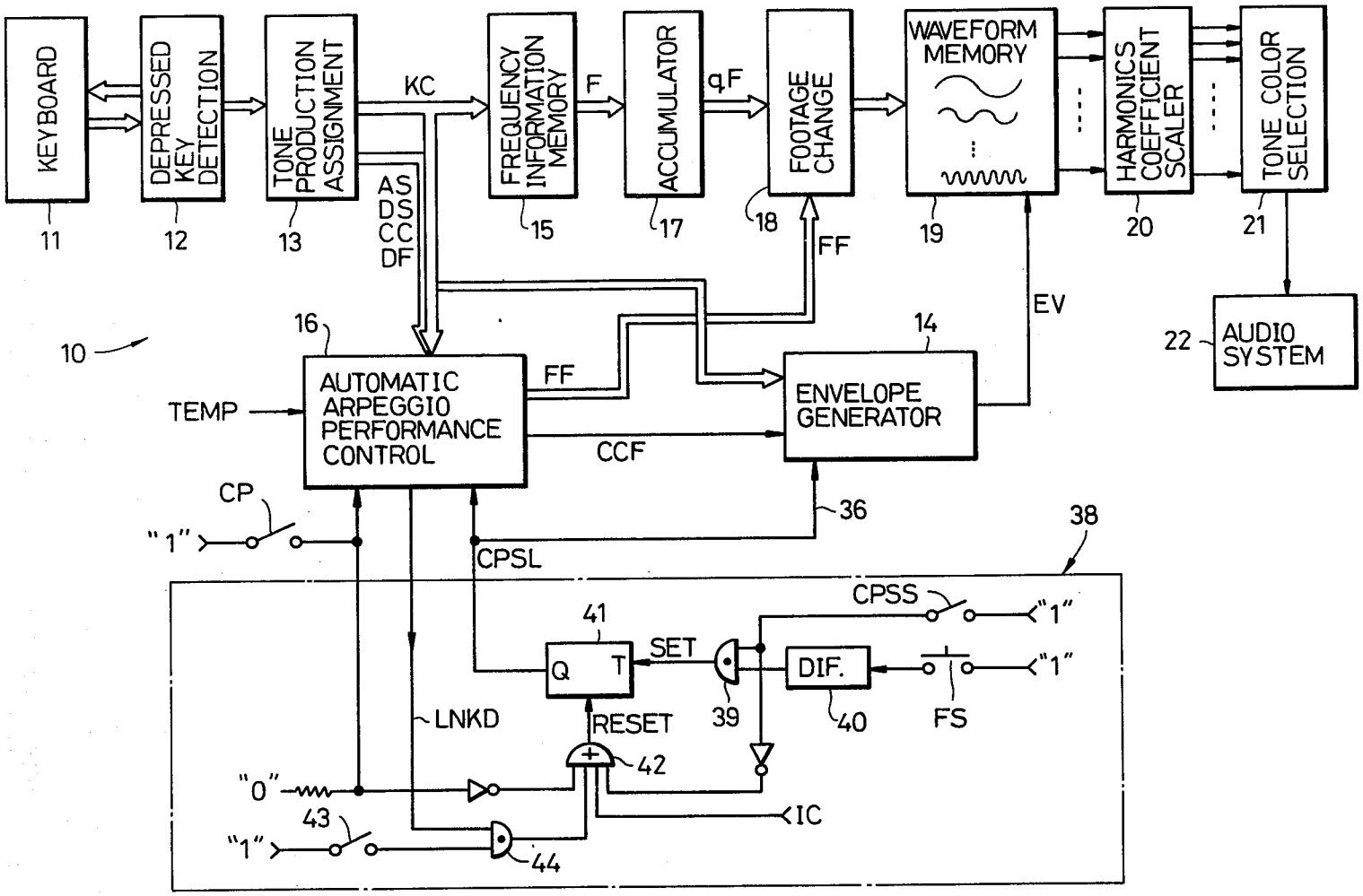
FIG. 1 is a block diagram illustrating one example of an electronic musical instrument having automatic performance functions to which the technical concept of this invention is applied.

An electronic musical instrument 10 shown in FIG. 1 is of a type capable of producing a plurality of tones simultaneously by a time division processing of signals. A keyboard 11 comprises a manually operated upper and lower keyboards and a pedal keyboard operated by foot.

A key depression detecting circuit 12 operates to detect the "on" or "off" operation of the key switch of each key in the keyboard 11 to output information for identifying a depressed key. A tone production assignment circuit 13 receives information identifying a depressed key from the key depression detecting circuit 12 and assigns the tone production of the key repressented by the information to one of the channels which corresponds to a maximum number of tones to be produced simultaneously (for instance twelve tones). The tone production assignment circuit 13 has storage positions corresponding to the channels. This circuit 13 operates to store a key code KC representative of a key in a storage position corresponding to the channel to which the tone production of the key is assigned, and successively output the key codes DC stored in the channels in time division. Accordingly, if a plurality of keys are being depressed simultaneously in the keyboard 11, tone production of the respective keys depressed are assigned to different channels and key codes KC representing the assigned keys are stored in the storage positions corresponding to the respective channels. Each storage position may be composed, for example, of a circulating type shift register.

In order to identify the keys in the keyboard, the key code KC consists of a 2-bit keyboard code $K_1$, $K_2$ representing a kind of keyboard, a 3-bit octave code $B_1$, $B_2$, $B_3$ representing an octave scale, and a 4-bit note code $N_1$, $N_2$, $N_3$, $N_4$ representing a note out of twelve notes in one octave, as indicated in Table 1. If the number of the channels is twelve, a shift register of 12 stages (1 stage consisting of 9 bits) may be used for the storage position.

Table 1

| Key | | Key code KC | | | | | | | | |
|---|---|---|---|---|---|---|---|---|---|---|
| | | $K_2$ | $K_1$ | $B_3$ | $B_2$ | $B_1$ | $N_4$ | $N_3$ | $N_2$ | $N_1$ |
| Keyboard | Upper | 0 | 1 | | | | | | | |
| | Lower | 1 | 0 | | | | | | | |
| | Pedal | 1 | 1 | | | | | | | |
| Octave scale | 1st | | | 0 | 0 | 0 | | | | |
| | 2nd | | | 0 | 0 | 1 | | | | |
| | 3rd | | | 0 | 1 | 0 | | | | |
| | 4th | | | 0 | 1 | 1 | | | | |
| | 5th | | | 1 | 0 | 0 | | | | |
| | 6th | | | 1 | 0 | 1 | | | | |
| Note | C# | | | | | | 0 | 0 | 0 | 0 |
| | D | | | | | | 0 | 0 | 0 | 1 |
| | D# | | | | | | 0 | 0 | 1 | 0 |
| | E | | | | | | 0 | 1 | 0 | 0 |
| | F | | | | | | 0 | 1 | 0 | 1 |
| | F# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |
| | C | | | | | | 1 | 1 | 1 | 0 |

Figure 2:
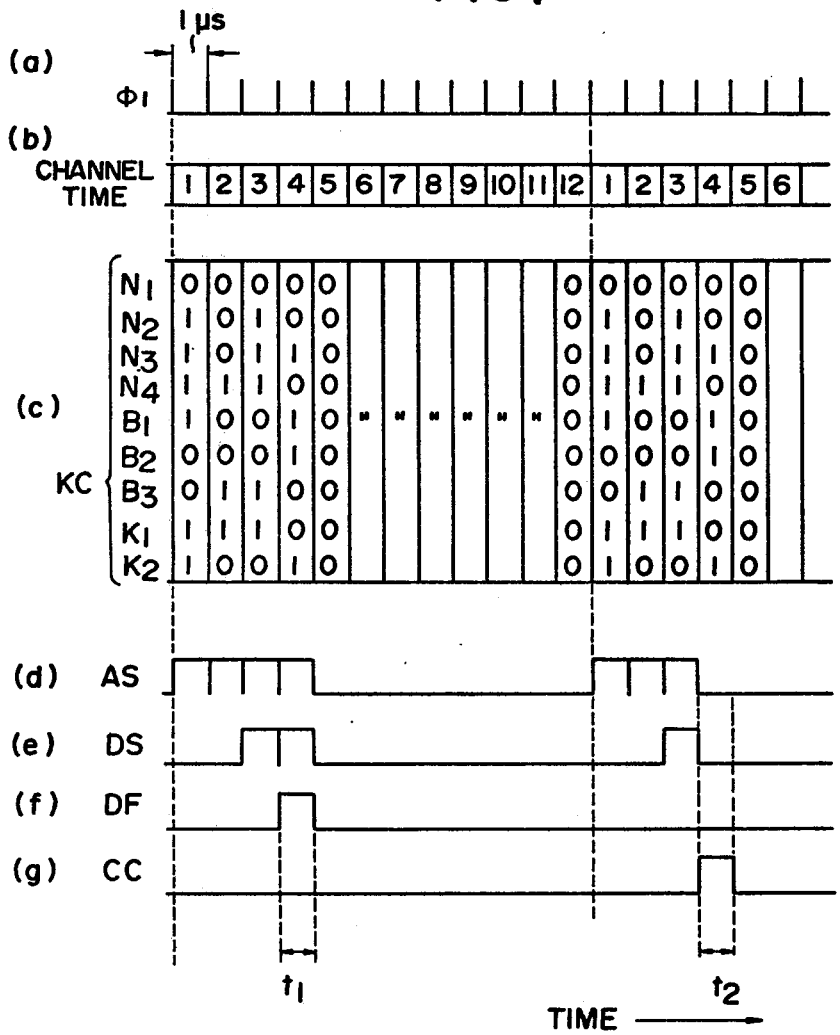
FIG. 2 is a timing chart for an explanation of the operation of a tone production assigning circuit shown in FIG. 1.

In the present embodiment, counters, logical circuits and memories are constructed in dynamic logic so that these component parts can be commonly used in time sharing manner for enabling simultaneous production of a plurality of tone. Accordingly, time relations between clock pulses controlling these component parts are very important. Part (a) of FIG. 2 shows a mian clock pulse $\phi_1$ used for controlling time shared operations of the respective channels and having a period of 1 microsecond ($10^{-6}$ sec.). Since there are twelve channels in this embodiment, time slots defined by the main clock pulse $\phi_1$ and each having width of 1 microsecond are made to correspond sequentially to the first through twelfth channels. The respective time slots are hereinafter referred to as the first channel time through the twelfth channel time, as shown in part (b) of FIG. 2. Each of these channel times occurs circulatingly. Accordingly, the key code KC representing a key whose tone production has been assigned by the tone production assignment circuit 13 is sequentially provided in synchronism with the channel time of the assigned channel. Assume, for example, that the note C of the second octave of the pedal keyboard has been assigned to the first channel, the note G of the fifth octave of the upper keyboard to the second channel, the note C of the fifth octave of the upper keyboard to the third channel, the note E of the fourth octave of the lower keyboard to the fourth channel and no tone production has been assigned to the reset of the channels (fifth through twelfth channels). In this case, contents of the key codes KC are shown in part (c) of FIG. 2. Assume further that the outputs of the fifth through the twelfth channels are all signal "0".

The tone production assignment circuit 13 produces in a time division manner an attack start signal (or a key-on signal) AS representing that tone production should be made in a channel to which the tone production of a depressed key has been assigned in synchronism with the channel time corresponding to the assigned channel. The circuit 13 also produces a decay start signal (or a key-off signal) DS representing that the key whose tone production was assigned to a specific channel has been released in synchronism with the channel time corresponding to the channel. These signals AS, DS are utilized in an envelope generator 14 for controlling the amplitude envelope of the musical tone. Furthermore, the tone production assignment circuit 13 receives a decay finish signal DF representing that the tone production in the channel has finished from the envelope generator 14 and produces, in response to this decay finish signal DF, a clear signal CC which clears various stored data concerning the channel and thereby cancels assignment of the tone production in this channel. In the example shown in part (c) of FIG. 2, if the keys assigned to the first and second channels are presently being depressed, the keys assigned to the third and fourth channels have been released with the tones for these keys being in a decaying state, and the decay finish signal DF is generated at a time slot $t_1$ and the clear signal CC is generated at a time slot $t_2$ which is 12 channel times later in the fourth channel, the signals AS, DS, DF and CC shown in parts (d)-(g) in FIG. 2 are produced. Since the clear signal CC is produced at the time slot $t_2$, the attack start signal AS and the decay start signal DS in the fourth channel are cancelled. At this time, the key code KC in the fourth channel in part (c) of FIG. 2 is cancelled, though it is present in the figure for convenience of description.

The channels to which the various signal KC, AS, DS and CC outputted by the tone production assignment circuit 13 belong are distinguished by the channel times as shown in FIG. 2.

In this instrument, various other signals are produced in time division in synchronism with their channel times.

The key code KC thus produced repeatedly in synchronism with its channel time is supplied to a frequency information memory 15 and an automatic arpeggio performance control device 16.

The frequency information memory 15 stores frequency information F (constants) corresponding to the key codes KC of the respective keys. This memory 15 is composed, for example, of a read-only memory. When a certain key code KC is applied to the memory 15, frequency information F stored at an address designated by the key code KC is read out. The frequency information F is regularly and successively accumulated by an accumulator 17 and used for sampling the amplitude of the musical tone at a predetermined interval. Accordingly, the frequency information F is a digital value proportional to the musical tone frequency for the key. The value of the frequency information F is determined if the value of the musical tone frequency is determined at a certain constant sampling speed. Assume, for example, that sampling of one musical tone waveform has been completed when a value qF (where q=1, 2, 3 . . . ) obtained by successively accumulating the frequency information F by the accumulator 17 has reached 64 in a decimal notation and that this accumulation is completed every 12 microseconds in which one circulation of the entire channel times is completed, the value of the frequency information F is determined by an equation.

$$F=12\times 64\times f\times 10^{-6}$$

where f is a frequency of the musical tone. This value F is stored in the frequency information memory 15 in accordance with the frequency f to be obtained.

The accumulator 17 is composed of a counter which cumulatively adds the frequency information F of the respective channels at a predetermined sampling rate (i.e., at a rate of 12 microseconds for each channel time) to obtain a cumulative value qF and thereby advances the phase of the tone source waveform. When the cumulative value qF has reached 64 in a decimal notation, the accumulator overflows and returns to 0 thereby completing reading out of one waveform. For accumulating data F of the respective channels, the accumulator 17 may preferably be composed of an adder of plural stages and a shift register of 12 stages corresponding to the number of the channels.

The tone source waveform is divided into a plurality of sample points (e.g. 64) and amplitude values at respective sample points are stored in the respective addresses of a waveform memory 19. The value qF which is the output of the accumulator 17 constitutes an input designating the address to be called in the memory 19. Tone source waveforms of tones assigned to the respective channels are read out in a time division manner from the waveform memory 19 in response to the value qF provided in time division for each of the channels.

A footage change circuit 18 inserted between the accumulator 17 and the waveform memory 19 is constructed in such a manner that a binary bit position of the cumulative value qF outputted from the accumulator 17 is suitably shifted in accordance with the octave switching signal FF. The output qF of the accumulator 17 is applied directly to a corresponding one of the waveform memory 19 if the octave change is not designated. If the octave change has been designated by the signal FF, the value qF is converted to a value which is double, four times or eight times . . . as large as the original value in accordance with the amount of the octave change and thereafter is applied to the waveform memory 19.

By converting the value qF to a value which is double, four times or eight times . . . as large as the original value by the footage change circuit 18, a sampled amplitude value at an address which is advanced by double, four times, eight times . . . from the address designated by the original value qF is read from the waveform memory 19. This means that the musical tone frequency obtained becomes double, four times, eight times . . . and, accordingly, the tone pitch of the produced tone is raised by one octave, two octaves, three octaves, etc.

The octave switching signal FF for specifying an octave switching amount is supplied from the automatic arpeggio performance control device 16.

In this example, necessary harmonic waveforms are synthesized with predetermined relative amplitudes in the harmonic coefficient scaler 20 to provide tone colors, and therefore the waveform memory 19 is provided with n sinusoidal waveform memories whose frequencies are in harmonic relation. That is, the waveform memory 19 stores sinusoidal waveforms corresponding respectively to n harmonic frequencies individually, and the orders of the harmonic stored are the first (fundamental), the second, the third, . . . and the nth. The harmonic waveforms read out of the waveform memory 19 are applied to the harmonic coefficient scaler 20 where after the relative amplitude of the harmonic waveforms are adjusted, the harmonic waveforms are mixed so as to provide the predetermined tone colors.

The output of the harmonic coefficient scaler 20 is applied to the tone color selection circuit 21. The tone color selection circuit 21 operates to select and mix the colored tones by operating variable resistors. The output of the tone color selection circuit 21 is produced by an audio system 22.

The envelope generator 14 generates in time division manner envelope signals EV for the respective channels for controlling the tone volume envelope in response to key depression or key release, so that the amplitude of the waveform signal read out of the waveform memory 19 is controlled to vary with time.

In this example, the circuitry is so designed that the automatic arpeggio performance is effected by using the lower keyboard, and therefore, in the automatic arpeggio performance control device 16, the automatic performance control is carried out by using the key code KC of the lower keyboard tone. In other words, the automatic control performance control device 16 detects the key codes for the lower keyboard out of the key codes KC supplied in time division manner, and selects the lower keyboard key codes in the order of tone pitches and at suitable tone production timing. An automatic arpeggio tone production command signal CCF is produced in synchronization with the channel times to which the selected key codes are assigned.

Figure 3:
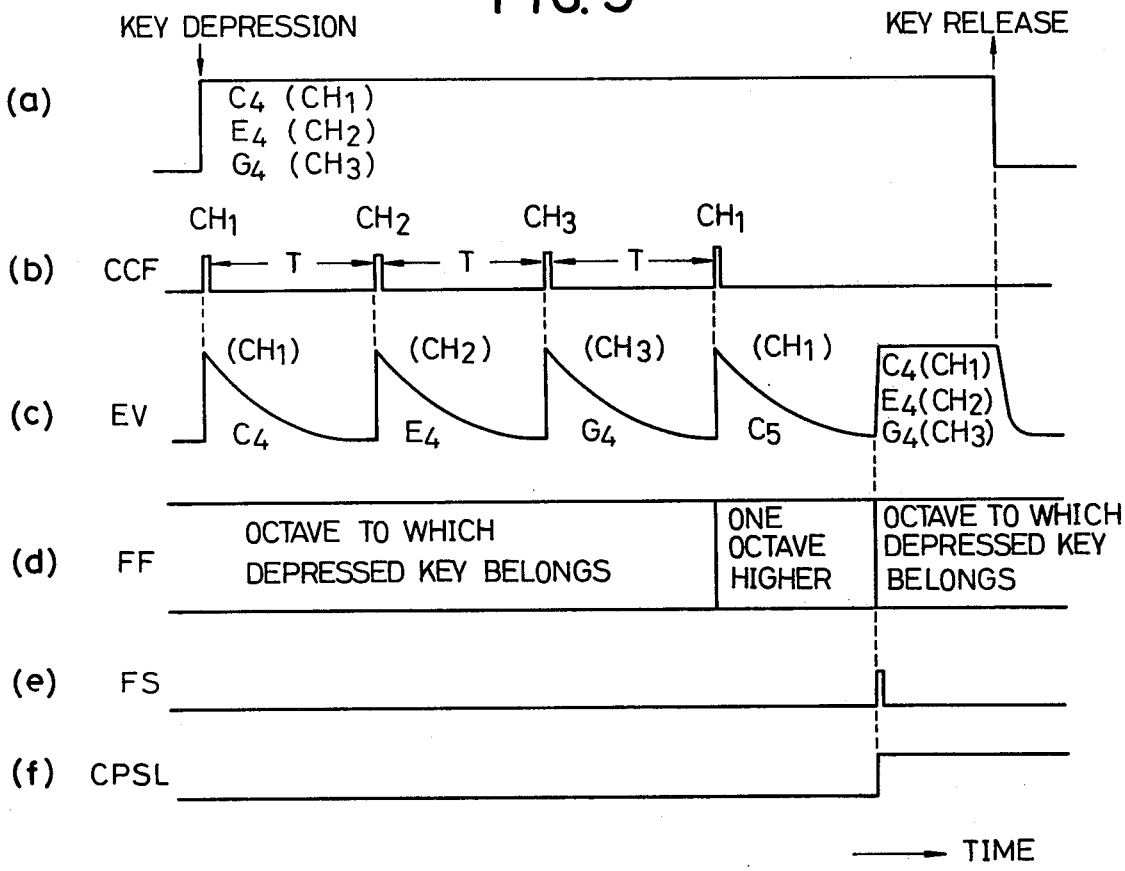
FIG. 3 is also a timing chart for a description of the operations of an automatic arpeggio performance control device and a foot switch control circuit employed in the electronic musical instrument shown in FIG. 1.

Referring to FIG. 3, the operation of the automatic arpeggio performance control device 16 will be briefly described. It is assumed that three keys for notes $C_4$, $E_4$ and $G_4$ in the lower keyboard are depressed, and the tone production assignment circuit 13 assigns the notes $C_4$, $E_4$ and $G_4$ to the first channel ($CH_1$), the second channel ($CH_2$) and the third channel ($CH_3$), respectively. The part (a) of FIG. 3 indicates that the aforementioned keys are being depressed. In the automatic arpeggio performance control device 16, the key code KC of the lowest note $C_4$ is first detected, and the automatic arpeggio tone production command signal CCF is produced in synchronization with the first channel ($CH_1$) to which the note $C_4$ is assigned ((b) of FIG. 3). In the automatic arpeggio performance control device 16, a predetermined number of tempo clock pulses TEMP are counted from the time of the key depression, and the key code KC of the next higher note ($E_4$) is detected upon lapse of time T from the start of tone production of the preceding note ($C_4$). According to this detection, the automatic arpeggio tone production command signal CCF is produced in synchronization with the second channel time ($CH_2$) to which the note $E_4$ is assigned (the part (b) of FIG. 3). Furthermore, upon lapse of the time, the key code KC of the note $G_4$ is detected, and the automatic arpeggio tone production command signal CCF is produced in synchronization with the third channel time ($CH_3$) to which the note $G_4$ is assigned. Thus, the detection of the notes of the depressed keys is carried out in the order of tone pitches one note per predetermined time T, and this is repeated. Upon production of the automatic arpeggio tone production command signal CCF, the tone production of the note which is assigned to the channel for which the command signal CCF has been produced is effected. Accordingly, the tone production interval of the automatic arpeggio is the aforementioned time T which is obtained according to the tempo clock pulse TEMP. It is possible to vary the frequency of this tempo clock pulse TEMP.

The automatic arpeggio tone production command signal CCF is applied to the envelope generator 14, and the percussion system envelope signal EV is produced at the channel time at which the signal CCF is produced. More specifically, when the automatic arpeggio tone production command signal CCF is produced at the first channel time ($CH_1$), the envelope generator 14 produces the percussion system envelope signal EV in synchronization with the first channel time ($CH_1$), whereby the tone source waveform signal of the note $C_4$ assigned to the first channel, being given with the percussion envelope, is read out of the waveform memory 19 in time division manner. In this operation, no envelope signal EV is provided for the other second and third channels, and therefore the tone source waveform signals of the notes $E_4$ and $G_4$ are not read out of the waveform memory 19. Similarly, when the automatic arpeggio tone production command signal CCF is produced at the second channel time ($CH_2$), the percussion system envelope signal EV is produced in time division manner by the envelope generator 14 in synchronization with the second channel time ($CH_2$), and the tone of the note $E_4$ with the percussion envelope is produced ((c) of FIG. 3).

The contents of the octave switching signal FF, as indicated in (d) of FIG. 3, first specifies the same octave as that in a key depression; however, when the key depression notes $C_4$–$G_4$ have all been produced, the contents of the octave switching signal FF is changed to shift the octave range to have the tones in an octave higher, for instance, one octave. Accordingly, next to the production of the tone of the highest note $G_4$, the tone production of the note $C_5$ higher by one octave than the note $C_4$ is effected.

Figure 4:
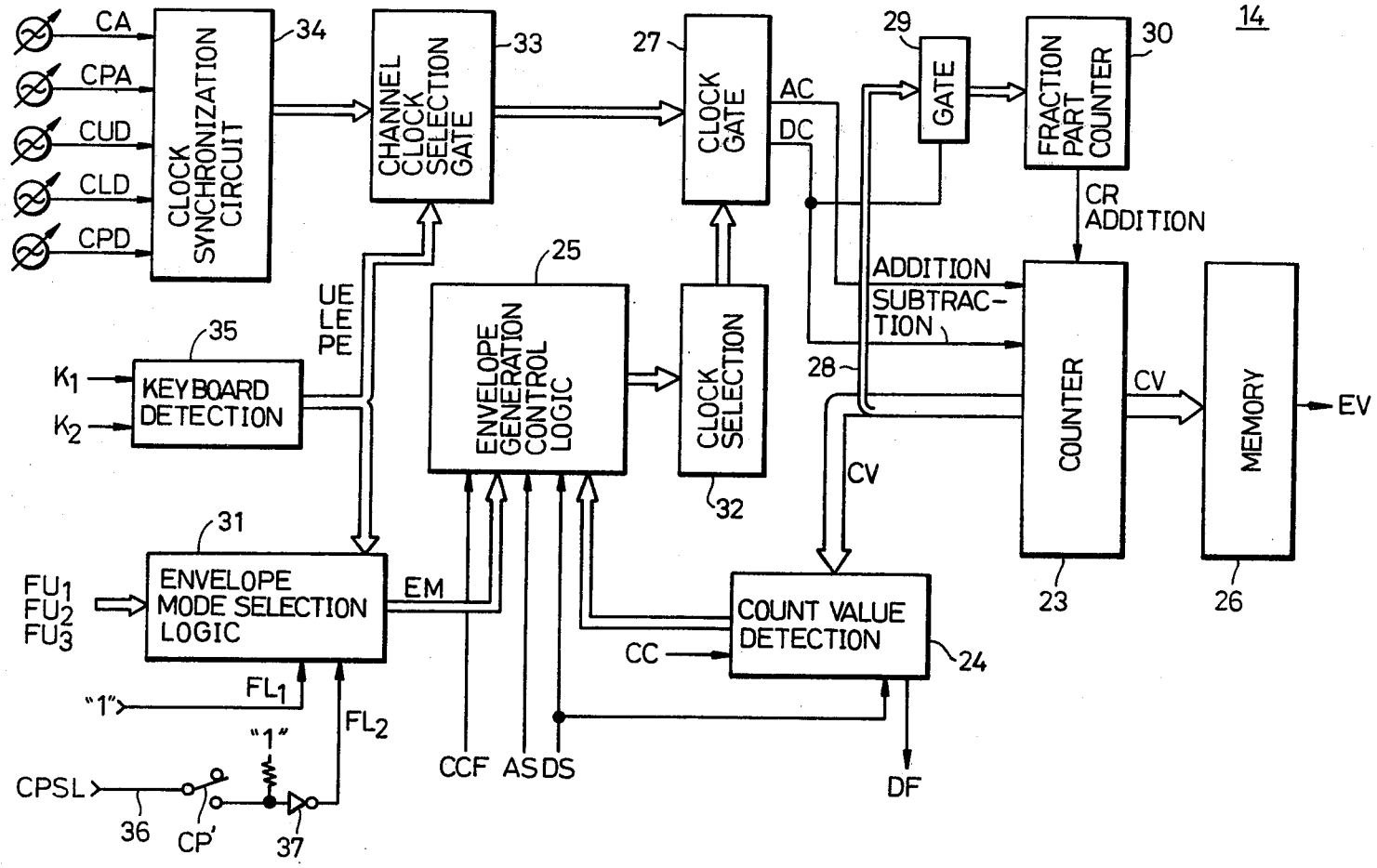
FIG. 4 is a block diagram briefly illustrating one example of an envelope generator employed in the electronic musical instrument shown in FIG. 1.
Figure 5:
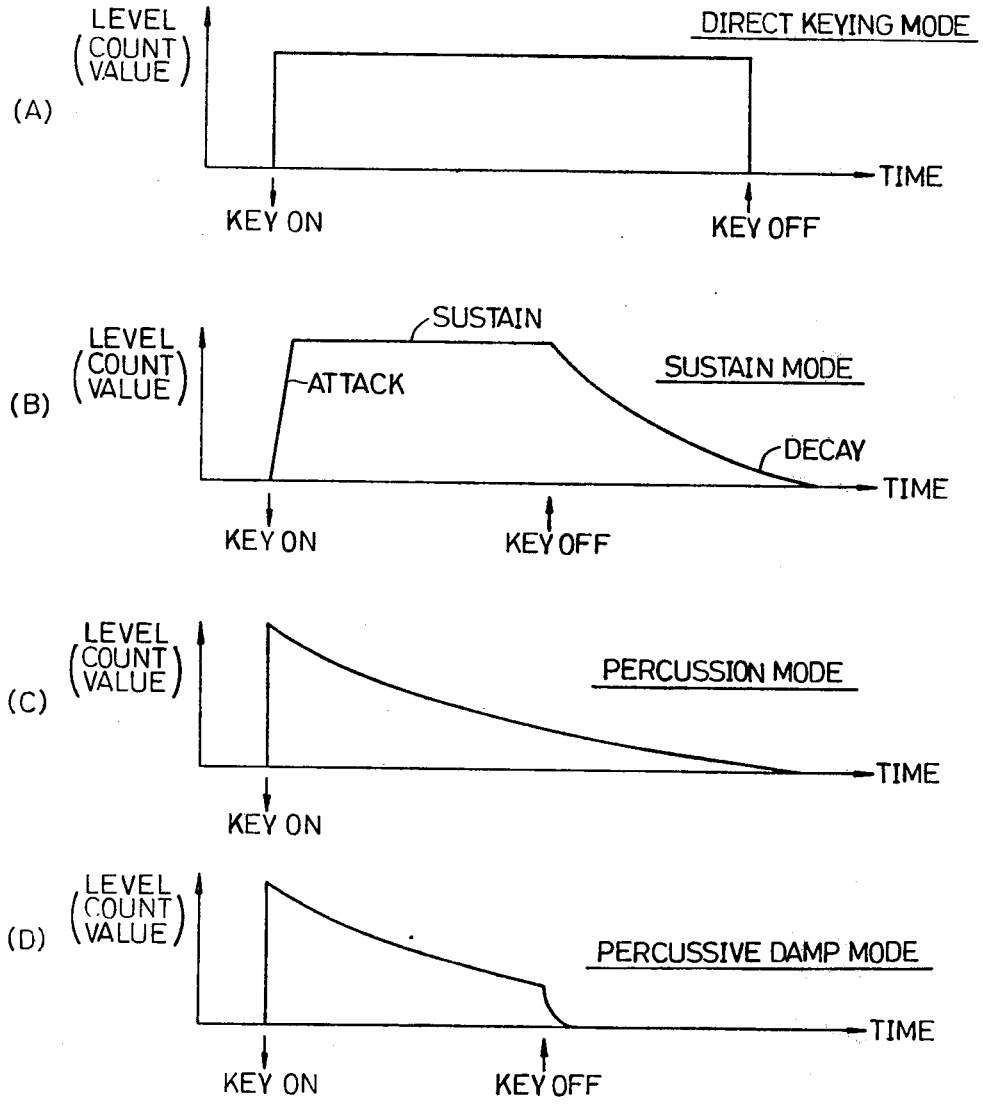
FIG. 5 is a graphical representation indicating the modes of envelope waveforms which can be produced by the envelope generator shown in FIG. 4.

One example of the envelope generator 14 is shown in FIG. 4. A counter 23 is so designed as to carry out counting operations separately according to the respective channels and in time division manner, and an envelope waveform signal having a shape corresponding to the variations in count value of the counter 23 is produced by the envelope generator 14. The envelope generator 14 is capable of selectively generating envelope waveforms in four different modes as shown in (A) through (D) of FIG. 5. The part (A) of FIG. 5 shows a direct keying mode envelope waveform, a kind of a sustaining mode. The level of the waveform is maintained unchanged for the period of key depression, i.e. from the beginning of key depression to the ending of key depression, or key release. The part (B) of FIG. 5 shows another sustain mode envelope waveform which consists of an attack part which rises abruptly to the highest level upon depression of a key, a sustain part whose level is maintained unchanged during the key depression, and a decay part whose level is decreased to zero after the key release. The part (C) of FIG. 5 shows a percussion mode envelope waveform which rises to the highest level upon depression of a key and thereafter decays. The part (D) of FIG. 5 shows a percussive damp mode envelope waveform which rises to the maximum level upon depression of a key, then decays gradually, and finally decays abruptly upon release of the key. The level of the envelope waveform corresponds to the count valve of the counter 23. Accordingly, the attack part of the sustain mode envelope waveform can be realized by the addition count of the counter 23. The decay part, or the decay waveform in the percussion mode or in the percussive damp mode can be realized by the subtraction count of the counter 23. In addition, if the counter 23 is caused to carry out an approximate exponential calculation, the decay waveform will become a waveform having an exponential characteristic in polygonal line approximation. The channel in which the key depression has been done can be detected from the attack start signal AS supplied in time division manner from the tone production assignment circuit 13. The channel in which the key release has been effected can be detected from the decay start signal DS. If the count value of the counter 23 becomes zero during the production of the decay start signal DS, it means the completion of the decay, and a decay finish signal DF is outputted by a count value detection circuit 24.

In FIG. 4, the count output of the counter 23 is supplied to a memory 26 where it is converted into envelope amplitude information having a value corresponding to the count value CV thereof.

The count value of the counter 23 is increased with the aid of attack clock pulses AC supplied from a clock gate 27 and is decreased with the aid of decay clock pulses DC therefrom. In the case where an exponentially variable decay envelope waveform is obtained by polygonal line approximation, the data of predetermined more significant bits in the counter 23 are fed back to a fraction part counter 30 through a line 28 and a gate 29 with the timing of the decay clock pulses DC. A carry signal CR provided as a result of the calculation of the fraction part counter 30 is applied to the addition input of the counter 23. The extent of subtraction with the decay clock pulses DC is varied according to the frequency at which the carry signals CR is applied from the fraction part counter 30, and the count value is exponentially varied.

The variation with time of the count value CV of the counter 23 corresponds to the shape of the generated envelope. Therefore, envelope waveforms having various shapes can be provided by controlling the count operation of the counter 23. The count value detection circuit 24 operates to detect the fact that the count value of the counter 23 reaches a predetermined value, and to apply a signal representative of the particular state of the counter 23 to an envelope generation control logic 25. This envelope generation control logic 25 is a circuit for generating an envelope waveform having a desired shape by controlling the addition or subtraction, the counting rate, and the start and stop of the counting operation at the counter 23, and in the envelope generation control logic 25 the mode of an envelope waveform is specified by an envelope mode selecting signal EM supplied from an envelope mode selection logic 31.

A clock selection circuit 32 operates to open a clock gate 27 in response to the output of the envelope generation control logic 25, and to cause one of the plural clock pulses supplied from a channel corresponding clock selection gate 33 to be applied, as an attack clock pulse AC or a decay clock pulse DC, to the counter 23. In this example, different attack clock pulses or decay clock pulses are employed separately according to the kinds of keyboard, so that the attack time or the decay time is different according to the kinds of keyboard, even if the envelope shapes are identical. Accordingly, an attack clock signal CA for the upper keyboard and the lower keyboard, an attack clock signal CPA for the pedal keyboard, a decay clock signal CUD for the upper keyboard, a decay clock signal CLD for the lower keyboard signal, and a decay clock signal CPD for the pedal keyboard are oscillated respectively, and are applied to the channel corresponding clock select gate 33 through a clock synchronization circuit 34. The clock synchronization circuit operates to synchronize the pulse width of each of the clock signals CA–CPD with one cyclic period (12 microseconds) of all the channel times.

A keyboard detection circuit 35 operates to decode the keyboard codes $K_1$, $K_2$ out of the key codes KC supplied in time division manner from the tone production assignment circuit 13, and to output an upper keyboard signal UE, a lower keyboard signal LE or a pedal keyboard signal PE according to the contents of the keyboard code. These keyboard signals UE, LE, and PE operate to open the channel corresponding clock selection gate 33 in time division manner according to their generation time slots, thereby to select in time division manner the clock pulses corresponding to the keyboards of the tones assigned to the channels. The clock pulses thus selected are multiplexed separately according to the attack clock and the decay clock, and are applied to the clock gate 27.

In response to the envelope function switching data $FU_1$, $FU_2$, $FU_3$, and $FL_1$, $FL_2$ and to the keyboard signals UE, LE and PE, the envelope mode selection logic 31 outputs in time division manner and separately according to the respective channels the envelope mode selection signals EM corresponding to the functions selected by the performer.

The 3-bit envelope function switching data $FU_1$, $FU_2$, $FU_3$ is to select the envelope function of the upper keyboard tone, while the 2-bit envelope function switching data $FL_1$, $FL_2$ is to select the envelope function of the lower keyboard tone. For the pedal keyboard tone, no particular selection data is necessary, because only one envelope function is selected at all times. As is apparent from the above description, the circuitry in this example is so designed as to select the envelope functions separately according to the kinds of keyboard.

In this example, the automatic arpeggio performance is effected with the lower keyboard. Therefore, the invention will be described with reference to the envelope function switching data $FL_1$, $FL_2$ for the lower keyboard tones.

The data $FL_1$, $FL_2$ is to specify the mode of the envelope signal EV which is to be produced for the lower keyboard by the envelope generator 14. Since this data $FL_1$, $FL_2$ is applied in a direct current mode, it is time-divided according to the keyboard signals UE, LE and PE thereby to be converted into the envelope mode selecting signal EM in the envelope mode selection logic 31.

Upon operation of the automatic arpeggio selection switch CP (FIG. 1) which is manually operated by the performer, the automatic arpeggio performance device 16 is placed in it operating state, as a result of which as shown in FIG. 3 the automatic arpeggio performance control can be effected and the automatic arpeggio performance is effected. In FIG. 4, with respect to the envelope generator 14, automatic arpeggio selection switch CP′ operating in association with the aforementioned automatic arpeggio selection switch CP is provided. In the case of the automatic arpeggio performance, the switch CP′ is switched from the position shown in FIG. 4 to the other position, and the signal of a line 36 to which an automatic arpeggio performance temporarily suspending signal CPSL is supplied is applied to an inverter 37. As the level of this signal CPSL is normally at the "0" level as described later, the level of the output, or the data $FL_2$ of the inverter 37 is raised to "1". As the data $FL_1$ is fixed to be at the level "1" at all times, the envelope function switching data $FL_1$, $FL_2$ will become "1 1". When the envelope function switching data $FL_1$, $FL_2$ is "1 1", the envelope mode selection logic 31 outputs the envelope mode selecting signal EM selecting the percussion mode ((C) of FIG. 5), while the envelope generation control logic 25 controls the count operation of the counter 23 so that the envelope signal EV is produced.

In the case when the percussion mode envelope is selected, upon application of the automatic arpeggio tone production command signal CCF to the envelope generation control logic 25, the contents of the relevant channel in the counter 23 is set to a maximum value, and thereafter the subtraction is successively carried out, as a result of which the percussion envelope signals EV of decaying characteristic are generated in the relevant channel in time division manner.

Referring to FIG. 1, a foot switch control circuit 38 is a circuit for temporarily suspending the automatic arpeggio performance by the operation of a foot switch FS which is operated by the performer's foot or leg. An automatic arpeggio stop switch CPSS is provided so that the automatic arpeggio control can be effected by the foot switch FS. If this switch CPSS is closed in advance, and AND circuit 39 is enabled, as a result of which the automatic arpeggio control can be effected by the foot switch FS. Upon closure of the foot switch FS, a single pulse is produced by a differentiation circuit 40, and is applied to the AND circuit 39, as a result of which a flip-flop circuit 41 is set. The output "1" of this flip-flop circuit 41 is the automatic arpeggio performance temporarily suspending signal CPSL. This signal CPSL is applied to the automatic arpeggio performance control device 16, thereby to temporarily suspend the automatic arpeggio performance. When the level of the signal CPSL is raised to "1", the various memory circuits in the device 16 are reset, and the various gates are made inoperable. As a result, the automatic arpeggio performance is suspended even if the automatic arpeggio selecting switch CP has been closed. Therefore, the automatic arpeggio tone production command signal CCF is no longer produced, and the octave switching signal FF specifies an octave as that in key depression (that is, the octave is not switched).

When the level of the signal CPSL applied to the automatic arpeggio selection switch CP' (in FIG. 4) through the line 36 is raised to "1", the data $FL_2$ becomes "0", and the envelope function switching data $FL_1$, $FL_2$ is automatically changed from "11" to "10". When the data $FL_1$, $FL_2$ is "10", the envelope mode selecting logic 31 outputs the envelope mode selecting signal EM for selecting the sustain mode ((B) of FIG. 5). As a result, the envelope mode concerning the lower keyboard tone of the envelope generator 14 is automatically switched from the percussion mode to the sustain mode.

For instance, if the automatic arpeggio performance temporarily suspending signal CPSL, as shown in (f) of FIG. 3, is produced by operating the foot switch FS ((e) of FIG. 3) during the depression of a key in the lower keyboard ((a) of FIG. 3), the model of the envelope generated by the envelope generator 14 is switched over to the sustain mode.

In the case of the percussion mode, subtraction is carried out until the count value of the counter 23 in the envelope generator 14 reaches zero (0), and therefore the count value of the counter 23 is zero (0) when the percussion mode is switched to the sustain mode. However, in the case of the sustain mode, as long as a key maintained depressed, a predetermined count value (the maximum count value) is maintained in the counter. Therefore, if when the mode is changed to the sustain mode, a key in the lower keyboard has been depressed (the attack start signal AS of the lower keyboard being at the level "1", the decay start signal DS being at the level "0", ), immediately the counter 23 produces the envelope for the attack part through addition calculation. After the count value of the counter reaches a predetermined value, the value is maintained until the key is released. In this manner, the sustain mode envelope signal EV is provided. In the example of FIG. 3, as three keys $C_4$, $E_4$ and $G_4$ are depressed, the sustain mode envelope signals EV are produced in time division manner at the first, second and third channel times, respectively. Accordingly, upon operation of the foot switch FS, three tones of the keys $C_4$, $E_4$ and $G_4$ depressed are simultaneously produced as a sustaining tone (see (c) of FIG. 3). Of course, the envelope is decayed upon release of a key as shown in (a) of FIG. 3.

The flip-flop circuit 41 which has stored the operation of the foot switch FS is reset by a signal provided by an OR circuit 42, as a result of which the level of the signal CPSL is changed to "0", and the automatic arpeggio performance temporary suspension is released. The automatic arpeggio stop switch CPSS is turned off, the flip-flop 41 is reset. In the case also when the automatic arpeggio performance is completely stopped by turning off the automatic arpeggio selecting switch CP, the flip-flop circuit 41 is reset. Furthermore, if when the electronic musical instrument 10 is energized, the initial clear signal IC is applied to the OR circuit 42, the flip-flop circuit 41 is reset. In addition, in the case where a synchro start switch 43 is closed, an AND circuit 44 is enabled. Therefore, a lower keyboard new key data LNKD representative of depression of a new key is applied to the AND circuit, the flip-flop circuit 41 is reset. Accordingly, in the case where the synchro start switch 43 is closed, the automatic arpeggio performance temporary suspension is automatically released by the depression of a new key in the lower keyboard.

When the level of the automatic arpeggio performance temporarily suspensing signal CPSL is changed to "0", the envelope function switching data FL, FL returns to "1 1" again and the envelope is automatically switched over to the envelope of the percussion mode if the automatic arpeggio selecting switch CP has been closed (the switch CP' being on).

In the above-described example, in switching the envelopes, the count conditions of the counter 23 in the envelope generator 14 are switched; however, it should be noted that the method of switching the envelopes is not limited thereto or thereby. For instance, with the provision of an envelope memory which has stored the envelope waveforms of the percussion system and an envelope memory which has stored the envelope waveforms of the pustain system, the envelopes to be used can be automatically switched according to the presence and absence of the automatic arpeggio performance temporarily suspending signal CPSL.

Figure 7:
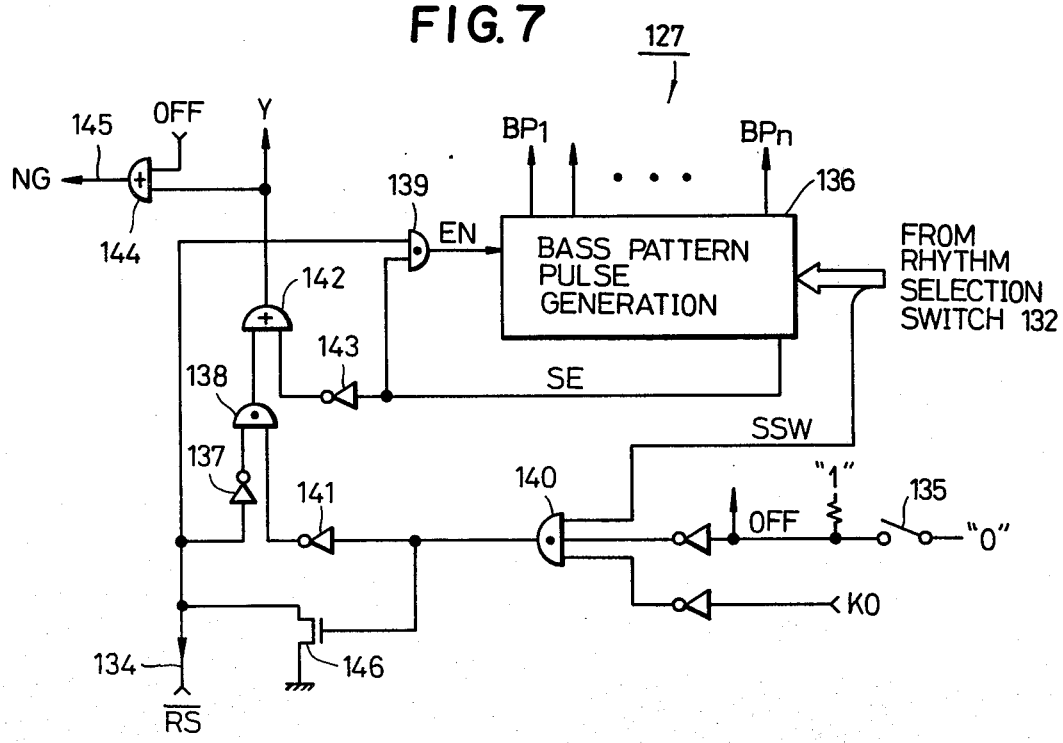
FIG. 7 is a block diagram illustrating in detail the essential components of the circuit shown in FIG. 6.
Figure 6:
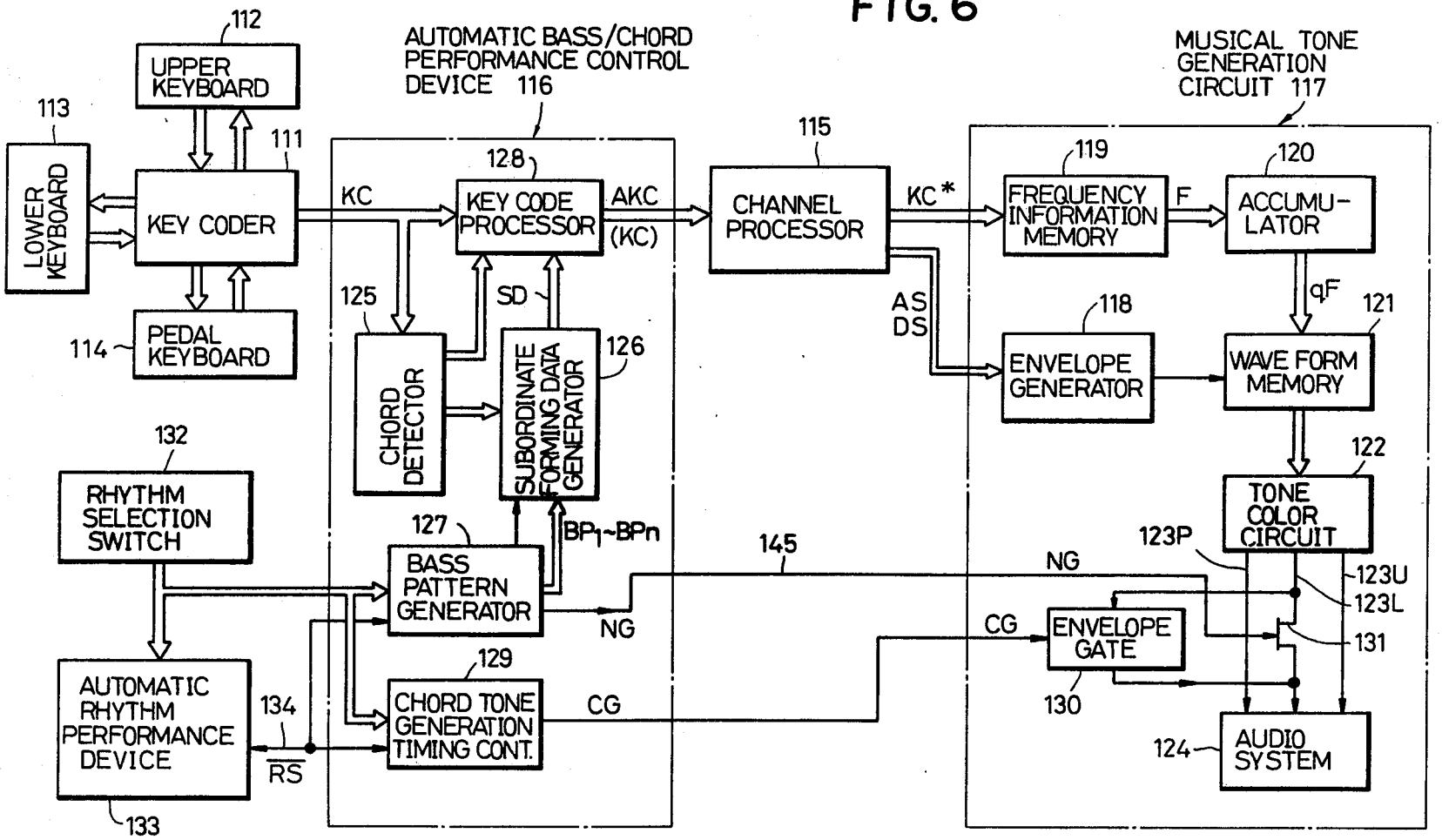
FIG. 6 is a block diagram illustrating one example of an electronic musical instrument having an automatic rhythm performance function, and automatic bass and chord performance functions, to which the technical concept of the invention is applied.

FIGS. 6 and 7 show one embodiment of the invention which is applied to an electronic musical instrument having an automatic rhythm performance device and an automatic bass/chord performance device.

In FIG. 6, a key coder 111 operates to detect the operations of the keys in the upper keyboard 112 for melody performance, the lower keyboard 113 for automatic bass/chord performance, and a pedal keyboard 114 for bass performance, and to produce key code signals representative of keys depressed. A key coder disclosed in the specification of U.S. patent application Ser. No. 714084 entitled "Channel Processor" can be employed as the key coder 111; this application has issued as U.S. Pat. No. 4,114,495 and is assigned to Nippon Gakki Seizo Kabushiki Kaisha, the same assignee as the present invention. Key codes KC similar to those in Table 1 are repeatedly provided by the key coder 111 in correspondence to plural keys being depressed.

The binary values of an octave code $B_1$, $B_2$, $B_3$ and a note code $N_1$, $N_2$, $N_3$, $N_4$ correspond to the pitch of a tone. For instance, whenever the binary vlaue of the octave code $B_1$–$B_3$ increases by 1, the octave range is raised by one octave. As the binary value of the note code $N_1$–$N_4$ increases, the note code represents a higher tone pitch; however, it should be noted that the weight of the binary value are not exactly corresponding to tone pitches. As is apparent from Table 1, the data "0011", "0111", "1011" and "1111" are not included in Table 1. This is to facilitate the key code medification of forming subordinate tones described later. In an ordinary case, a 12-note scale in one octave is formed by notes C, C#, D . . . B arranged in the stated order with the note C as the lowest tone. However, in the case of Table 1, if the octave code $B_1$–$B_3$ is assumed to be constant, the tone pitch order C#, D . . . B, and C is established. This means that if the octave code $B_1$–$B_3$ is identical, the octave range of the note C is higher than the octave range of the other notes C#–B. Therefore for example, when the code $B_3$, $B_2$ . . . $N_2$, $N_1$ is "000111", it represents note $C_2$; and when the code is "0010000", it represents note $C_2$#. In addition, if the code $B_3$ . . . $N_1$ is "1011101", it represents note $B_6$; and if the code is "1011110", it represents note $C_7$.

The above-described key coder described in the specification of U.S. Pat. No. 4,114,495 operates to extract only the key codes KC concerning keys depressed and to successively output the key codes KC thus extracted, with the time width of 24 microseconds per key code. When a key in the keyboard 112, 113 or 114 is released, the production of the key code concerning the key is stopped. In order that a channel processor 115 described later detects the key code whose production has been stopped (the key released), start codes SC are periodically produced by the key coder 111. The contents of the start code SC are as indicated in Table 2.

Table 2

| | $K_2$ | $K_1$ | $B_3$ | $B_2$ | $N_1$ | $N_4$ | $N_3$ | $N_1$ |
|---|---|---|---|---|---|---|---|---|
| Start code SC | 0 | 0 | 0 | 0 | 0 | 1 | 1 | 1 | 1 |

The start code SC generation time width in 24 microseconds equal to that of the key code KC, and the generation cycle of the start code SC is of the order of 5 milliseconds. When the start code SC is produced, the key code KC is not produced. When the key code having been produced is not produced at all during one cycle of the start code SC, the channel processor 115 will detect that the key concerning the key code has been released.

The channel processor 115 receives key code data supplied by the key coder 111 (or through an automatic bass/chord performance control device 116 described later), and assigns the tone production of a key corresponding to the key code data to one of the channels whose number corresponds to a maximum simultaneous tone production number (for instance, 12 tones). The channel processor 115 is provided with memory positions corresponding to the channels, so that a key code data for a key is stored in the memory position corresponding tothe channel to which the tone production of the key is assigned, and the key code data KC* thus stored are outputted in time division manner separately according to the respective channel times. The key code data KC* assigned to the respective channels is applied to a musical tone generation circuit 117 and a tone corresponding to the contents of the key code data KC* is produced. On the other hand, the channel processor 115 provides an attack start signal AS representing that tone production should be effected in the channel to which the key code data KC* has been assigned and a decay start signal DS representing that the key assigned to the channel is released (application of the key code to the channel processor 15 is suspended). These signals AS and DS are applied to an envelope generating circuit 118. A circuit such as that described in the specification of U.S. Pat. No. 4,114,495 aforementioned may be employed as the channel processor 115. The key code data KC* is applied to a frequency information memory device 119 by the channel processor 115. According to the key code KC* the frequency information memory device 119 read out a value F proportional to the musical tone frequency of the key represented by the key code KC*. An accumulator 120 accumulates the values F thus read out, thereby to form an address data qF for repeatedly reading a tone source waveform signal out of a waveform memory 121. An envelope generating circuit 118 operates to generate a musical tone amplitude envelope signal EV according to the data AS and DS respectively representative of the key depression and release which are applied thereto from the channel processor 115, and to vary with time the maximum amplitude of the tone source waveform signal repeatedly read out of the waveform memory 121, according to the amplitude of the aforementioned envelope signal. The envelope signal EV is a sustain envelope waveform which, for instance, consists of an attack part whose level rises to the maximum value upon depression of a key, a sustain part whose level is maintained constant until the key is released, and a decay part whose level is gradually decreased after the key is released. A tone color circuit 122 operates to control the tone color of the tone source waveform signal read out of the waveform memory 121 thereby to obtain a musical tone signal having a desired tone color. Out of the tone signals assigned to the various channels, the upper keyboard tone signals are collected at a line 123U, the lower keyboard tone signals are collected at a line 123L, and the pedal keyboard tone signals are collected at a line 123P.

In this example, as the automatic chord tone is produced as a lower keyboard tone, the chord tone is introduced to the line 123L of the lower keyboard tone. As the automatic bass tone is produced as pedal keyboard tone, the automatic bass is introduced to the line of the pedal keyboard tone.

The output of the tone color circuit 22 is sounded through an audio system 124. The musical tone generation as described above in the musical tone generating circuit 117 is effected in time division manner separately according to the various channels in correspondence to the tone production assignment in the channel processor 115.

The automatic bass/chord performance control device 116 connected between the key coder 111 and the channel processor 115 operates to receive the key code of a key (depressed) selected in the lower keyboard from the key coder 111, to provide a key code AKC corresponding to a bass tone in an automatic bass performance according to the key code KC thus received, or to provide key codes AKC corresponding to a chord composing tones in an automatic chord peformance. In other words, the automatic bass/chord performance control device 116, according to the key code KC of a key depressed in a keyboard, automatically forms the key code AKC of the key as is undepressed key were depressed, and applies the key code AKC to the channel processor 115.

A chord detecting section 125 receives the key code KC concerning the lower keyboard 113 and detects the root not of a chord provided by one or plural keys depressed and the kinds of chord (major, minor, seventh, etc.). A subordinate-tone forming data generating section 126 operates to generate a subordinate-tone forming data SD corresponding to a predetermined note interval in accordance with the kind of chord detected by the chord detecting section 125. The subordinate-tone forming data SD has a value corresponding to the note interval. It is necessary to determine the timing at which the subordinate-tone forming data SD corresponding to a certain interval should be provided. This determination is controlled by bass pattern pulses $BP_1$ through $BP_n$ outputted by a bass pattern generating section 127 according to a rhythm selected by a rhythm selecting switch 132. In a key code processing section 128, the value of the key code KC supplied thereto from the key coder 111 is changed in accordance with the value of the aforementioned subordinate-tone forming data SD. Using the key code KC from the key coder 111 as the root note a key code AKC corresponding to a subordinate-tone having a predetermined interval with respect to this root note is formed.

In this example, as the lower keyboard 113 is employed as a chord performance keyboard, the key codes KC concerning a plurality of key depressed in a chord manner in the lower keyboard 113 are applied to the channel processor 115 as they are, or without being changed by the key code processing section 128. These lower keyboard tones (chord composing tones) are assigned to the respective channels by the channel processor 115. A chord tone generation timing control section 129 operates to produce a chord tone generation timing signal CG according to the rhythm selected by the performer. The chord tone generation timing signal CG is applied to an envelope gate 130 provided in the route of the lower keyboard output line 123L of the muscial tone generating circuit 117, thereby to analogously apply an envelope of decay characteristic to the musical tone signal of the lower keyboard tone introduced to the line 123L and to produce it as an automatic chord tone. The envelope gate 130 is a circuit in which an envelope of decay characteristic is given to a musical tone with the generation timing of the chord tone generation timing signal CG for by utilizing, for instance, the charge-discharge characteristic of a capacitor.

A sustain tone gate 131 provided in parallel to the envelope gate 130 in the route of the lower keyboard output line 123L is closed when an automatic chord is performed. Accordingly, the lower keyboard tone is applied to the audio system 124 through the envelope gate 130, and the lower keyboard tones assigned to the various channels are simultaneously produced whenever the chord tone generation timing signal CG is generated. Thus, the automatic chord tone is produced intermittently. In other words, the chord is automatically produced in accordance with the chord tone generation timing signal CG.

On the other hand, the kind of a chord composed by one or plural keys depressed in the lower keyboard 113 is detected by the chord detecting section 125, and the subordinate tone forming data SD of a predetermined interval corresponding to the kind of chord detected by the chord detecting section 125 is applied to the key code processing section 128 in accordance with a bass advancement pattern corresponding to a rhythm selected by the performer. In the key code processing section 128, the key code corresponding to the root note of the chord detected by the chord detecting section 125 is stored, and the key code of the fundamental note thus stored is changed with the aid of the aforementioned subordinate tone forming data SD. This change is effected through addition calculation. In other words, the subordinate tone forming data SD corresponding to a desired interval is added to the key code KC of the root note so as to form the key code AKC of a subordinate tone having a predetermined interval with respect to the aforementioned root note. Referring to Table 1, if it is assumed that note G is the root note, the note code $N_4$–$N_1$ of the key code KC is "1 0 0 0". If the data SD "0 0 1 0" corresponding to the major second interval is added to the note code "1 0 0 0", a note code $N_4$–$N_1$ "1 0 1 0" of note A is formed. In this case, the note A is a subordinate tone having the major second interval with respect to the note G.

For the data $N_1$–$N_4$ formed by the key code processing section 28, a predetermined octave code $B_1$–$B_3$ and a keyboard code $K_1$, $K_2$ representing the pedal keyboard are provided, to form a key code data AKC for automatic bass. The key code data AKC thus formed is applied to the channel processor 115, and is assigned to a predetermined channel for tone production.

The automatic performance control device 116 is so designed that it can control the start or step of the performance mutually in association with the automatic rhythm performance control device 133 and other automatic performance device (for instance, the automatic arpeggio performance device shown in FIG. 1). For this mutual control, a reset signal $\overline{RS}$ on the line 134 is utilized. This reset signal $\overline{RS}$ is received and transmitted between the automatic performance devices. As described later, sometimes the reset $\overline{RS}$ is supplied from the side of the automatic bass/chord performance control section 116, and sometimes it is supplied from the side of the automatic rhythm performance device 133 or other automatic peformance devices.

For instance, in the case when the automatic rhythm performance is stopped in the automatic rhythm performance device 133, the reset signal $\overline{RS}$ at the level "0" is supplied to the line 134. When the level of the reset signal $\overline{RS}$ becomes "0", the generation of the bass pattern pulses $BP_1$ through $BP_n$ by the bass pattern generating section 127 of the automatic bass/chord performance control device 116 is suspended, and in addition the generation of the chord tone generation timing signal CG by the chord tone generation timing control section 129 is also suspended. Accordingly, when the automatic rhythm is stopped, the generation of the automatic bass tone and the automatic chord tone according to the bass pattern and the chord tone generation timing signal CG are prohibited. In addition, when the automatic rhythm performance is started, the level of the reset signal $\overline{RS}$ supplied from the automatic rhythm performance device 133 is raised to "1" from "0", whereupon the automatic bass/chord performance is started again according to the bass pattern and the chord tone generation timing signal CG.

The automatic rhythm performance is stopped when the operation of the automatic rhythm performance device 133 is temporarily suspended by operating a foot switch (not shown) which is operated by the performer's foot or leg, or when no rhythm is selected by the rhythm selecting switch 132 at all.

The essential components in the circuit which is provided for controlling the automatic bass/chord performance operation in the case when the automatic rhythm is stopped, are provided in the bass pattern generating section 127. One example of the bass pattern generating section 127 formed around these essential components is shown in FIG. 7.

First of all, various signals employed in the circuit shown in FIG. 7 will be described. The level of an automatic bass/chord performance off signal OFF becomes "1" when the automatic bass/chord performance control device 116 is not operated, and becomes "0" when an automatic bass/chord performance selecting switch 135 is closed. Upon closure of this switch 135, a state where an automatic bass/chord performance can be effected is established. The level of a key on signal KO is raised to "1" in a direct current mode when a key in the lower kayboard 113 for automatic bass/chord performance, and is changed to "0" when all keys in the lower keyboard 113 are released. This key on signal KO can be obtained from the key code data KC supplied from the key coder 111. The level of a synchro start signal SSW becomes "1" when a synchro start switch (not shown) provided in the rhythm selecting switch 132 is closed. The level of the a rhythm selection indicating signal SE outputted by a bass pattern pulse generating circuit 136 is "1" when a rhythm is selected by the rhythm selecting a switch 132, and is "0" when no rhythm is selected thereby. When no rhythm is selected, the bass pattern pulses $BP_1$ through $BP_n$ are not produced.

When the automatic rhythm performance is stopped, the level of the reset signal $\overline{RS}$ becomes "0". As a result, an AND circuit 138 is enabled through an inverter 137. On the other hand, an AND circuit 139 is made inoperable, as a result of which the level of a bass pattern generation possible signal EN is made to be "0", and the generation of the bass pattern pulses $BP_1$ through $BP_n$ is inhibited. The output of an AND circuit 140 is applied to the other input of the AND circuit 138 through an inverter 141. The inversion signal of the automatic bass/chord performance off signal OFF, the inversion signal of the key on signal KO, and the synchro start signal SSW are applied to the AND circuit 140. The output of the AND circuit 138 becomes a continuous tone generating signal Y through an OR circuit 142, to the other input of which a signal obtained by inverting the rhythm selection indicating signal SE by an inverter 143 is applied. Accordingly, the conditions required for generating the continuous tone generating signal Y (or raising the level of the signal Y to "1") are as follows:

(1) The level of the reset signal $\overline{RS}$ is "0", while the level of the off signal OFF is "1" (the automatic bass/chord performance is not selected).

(2) The reset signal $\overline{RS}$ is at the "0" level, and the key on signal KO is at the "1" level (a key is being depressed).

(3) The reset signal $\overline{RS}$ is at the "0" level, and the synchro start signal SSW is at the "0" level.

(4) The rhythm selection indicating signal SE is at the "0" level (no rhythm is being selected).

Accordingly, if, when the automatic bass/chord performance is selected (the signal OFF being at the "0" level) and the key for automatic bass/chord performance is being depressed (the signal KO being at the "1" level), and the automatic rhythm performance is stopped, the aforementioned condition (2) or (4) is satisfied, as a result of which the level of the continuous tone generating signal Y is raised to "1".

This continuous tone generating signal Y is applied to the subordinate tone forming data generating section 126, whereby the data SD corresponding to the interval of the first beat of the automatic bass tone (the root note, or the root note higher by one octave) is continuously generated. As a result, one key code data AKC corresponding to the interval of the first beat as the bass tone is repeatedly generated by the key code processing section 128. In the channel processor 115, the key code data AKC thus repeatedly generated is handled as one key is continuously depressed, and tone production thereof is assigned to a predetermined channel. Therefore, the bass tone is continuously outputted through the output line 123P of the tone color circuit 122, and the tone production of the bass tone (the pedal keyboard tone) is effected as a continuous tone by the audio system 124.

On the other hand, the output (the signal Y) of the OR circuit 142 becomes a continuous tone gate signal NG through an OR circuit 144, which is applied through line 145 to the gate control input of a sustain tone gate 131 in FIG. 6. As a result, the gate 131 is continuously opened, so that the lower keyboard tone (chord tone) on the line 123L is continuously conducted, and the chord tone is produced as a continuous tone. The automatic bass/chord performance off signal OFF is applied to the OR circuit 144. Therefore, the continuous tone gate signal NG is generated at all times, especially in the case where the automatic bass/chord performance is not selected.

As is apparent from the above description, when the automatic rhythm performance is stopped during the automatic bass/chord performance, the continuous tone generating signal Y and the continuous tone gate signal NG are generated in a direct current mode, and instead of the automatic bass tone and the automatic chord tone which have been intermittently produced according to the bass pattern and the chord tone production timing signal CG, the continuous bass tone or chord tone is automatically generated.

In addition, when the synchro start signal SSW is at the "1" level, the following synchro start control is carried out: When the synchro start signal SSW is at the "1" level, the automatic bass/chord performance off signal is at the "0" level, and the key on signal KO is at the "1" level; then the output of the AND circuit 140 is at the "0" level, and the signal "1" is applied through the inverter 141 to the AND circuit 138. If under this condition the automatic rhythm performance is stopped, the level of the reset signal $\overline{RS}$ applied by the automatic rhythm performance device 133 becomes "0". As a result, the condition of the AND circuit 138 is satisfied, and the continuous tone generating signal Y and the continuous tone gate signal NG are generated. Thus, the automatic bass tone and the automatic chord tone are produced as continuous tones. Now, if the key maintained depressed in the key board (the lower keyboard 113) for automatic performance is released, the level of the key on signal KO becomes "0", and the condition of the AND circuit 140 is met. Accordingly, the output level of the AND circuit 140 is raised to "1", and the level of the output of the inverter 141 becomes "0". As a result, the AND circuit 138 is made inoperable, and the continuous tone generating signal Y and the continuous tone gate signal NG are eliminated. Therefore, the bass tone and chord tone which have been continuously produced are eliminated.

The output "1" of the AND circuit 140 renders a field-effect transistor 146 conductive so as to forcibly place the signal on the line 34 to be at the "0" level. The reset signal $\overline{RS}$ placed at the "0" level is applied to the automatic rhythm performance device 133 and other automatic performance devices, as a result of which the automatic rhythm performance and other automatic performances are forcibly stopped by the action of the automatic bass/chord performance control device 116. Even if operation is made so as to start again the automatic rhythm performance which has been actively stopped by the side of the automatic rhythm performance device 133, the automatic rhythm performance is passively stopped because the reset signal $\overline{RS}$ is applied from the side of the automatic bass/chord performance control device 116. When one or a plurality of keys are newly depressed in the lower keyboard 113, the level of the key on signal KO is raised to "1", and the level of the output of the AND circuit 140 becomes "0". Therefore, the transistor 146 is rendered non-conductive, and the level of the reset signal $\overline{RS}$ on the line 134 is raised to "1" from "0". In the aforementioned automatic rhythm performance device 133 and other automatic performance devices (for instance, an automatic arpeggio device), the raising of the level of the reset signal $\overline{RS}$ to "1" from "0" is detected, and their own automatic performance are started in coincidence with the start of the automatic bass chord performance. This is the synchro start.

This example has been described in such a manner that the tone (the root note or the root note higher by one octave) of the first beat of the bass pattern is automatically and continuously produced as a bass tone; however, it should be noted that the invention is not limited thereto or thereby. For instance, it is possible to to continuously produce as a bass tone the tone corresponding to any one out of the notes composing a chord which have been selected by depressing keys in the lower keyboard 113.

Furthermore, in the above-described example, in analog type gates 130 and 131 are selectively controlled with the aid of the chord tone production timing signal CG and the continuous tone gate signal NG so as to control the tone production of the chord; however, it is also possible to effect the tone production control by controlling the' envelope generating circuit 118 with the aid of the signals NG and CG.

What is claimed is:

1. An electronic musical instrument of a type having an automatic performance device for producing a plurality of tones sequentially or simultaneously, said tones corresponding to key codes selected by depression of one or more keys, which comprises:

automatic performance stopping means for stopping the operation of said automatic performance device, control means for switching tone production from one mode to another upon operation of said automatic performance device, and an envelope generator that establishes the amplitude envelope of each produced tone, and wherein said automatic performance device is an automatic arpeggio performance device which cooperates with said envelope generator for sequentially producing tones with a percussion type envelope, and wherein said control means cooperates with said envelope generator to switch the envelope of the produced tones to a sustain type envelope upon stopping the operation of the automatic performance device, and wherein said control means includes a player actuated switch, and circuitry for producing an "arpeggio suspended" signal when said switch is actuated, said signal causing said arpeggio performance device to suspend arpeggio production, said instrument thereafter continuing simultaneous tone production of tones corresponding to all depressed keys, said signal also causing said envelope generator to switch the tone envelope to a sustain type envelope.

2. In a time shared electronic musical instrument of the type having a tone generator that is time shared to produce one or more musical tones in accordance with tone identifying key codes supplied to said tone generator during separate time shared channel times, an envelope generator that is time shared and cooperates with said tone generator to establish the amplitude waveform of the tone generated during each channel time, and an automatic arpeggio performance device which receives said supplied key codes and cooperates with said envelope generator to cause tone generation in an arpeggio mode, the improvement wherein said instrument includes:

automatic performance stopping means for stopping the operation of said automatic arpeggio performance device and for thereupon switching tone generation from said arpeggio mode to another mode, comprising:

envelope mode selection logic, cooperating with said envelope generator, for providing during separate channel times envelope mode selection signals that are utilized by said envelope generator to establish the type of amplitude waveform of the tone generated during each corresponding channel time, said arpeggio performance device normally providing to said envelope generator sequential arpeggio production command signals at repetitive arpeggio timing intervals and in unison with the channel times of sequentially different ones of said supplied key codes, said command signals causing said envelope generator to generate an envelope waveform only in unison with the key codes which are supplied during the channel times corresponding to the provided production command signals, no amplitude envelope waveform being generated for key codes supplied during other channel times, said command signals thereby causing sequential tone generation in said arpeggio mode, and a control switch circuit operative when actuated to provide an "arpeggio suspended" control signal, said arpeggio performance device, in the presence of said "arpeggio suspended" control signal, causing the envelope generator to produce an envelope waveform during each channel time for which a key code is supplied, thereby resulting in simultaneous generation of tones corresponding to said supplied key codes, said selection logic producing, in the presence of said "arpeggio suspended" signal, envelope mode selection signals that establish for said simultaneously generated tones a type of envelope waveform that is different from the type established in the arpeggio mode.

3. In an electronic instrument:

a tone generator for generating musical tones corresponding to key codes designating a chord and designating bass tones including a root tone and tones subordinate thereto, an envelope gate and a sustain tone gate both interconnecting said tone generator to an audio system, an automatic bass and chord performance device for supplying said key codes to said tone generator, an automatic rhythm performance device, a bass pattern control circuit for causing said automatic bass and chord performance device to supply to said tone generator key codes for a sequential pattern of bass tones, including both said root tone and said subordinate tones, with rhythmic timing established by said automatic rhythm performance device, chord tone generation timing control means for repetitively enabling said envelope gate with rhythmic timing established by said automatic rhythm performance device, said envelope gate being configured when enabled to impart a certain amplitude envelope to the chord tone concurrently generated by said tone generator and to supply the resultant tone to said audio system, and automatic mode termination control circuitry, responsive to actuation of an automatic bass and chord performance selection switch, for providing first, second and third control signals, said first signal causing said bass pattern control circuit and said automatic bass and chord performance device to terminate generation of said sequential pattern of bass tones and thereafter continuously to supply to said tone generator the key code of a single bass tone, said second signal enabling said sustain tone gate, thereby shunting the chord tones generated by said tone generator directly to said audio system rather than via said envelope gate, said third signal forcing termination of operation of said automatic rhythm performance device.

* * * * *